US009200519B2

(12) United States Patent
Nereim et al.

(10) Patent No.: US 9,200,519 B2
(45) Date of Patent: Dec. 1, 2015

(54) BELLY BAND SEAL WITH UNDERLAPPING ENDS

(71) Applicants: Brian D. Nereim, Winter Springs, FL (US); Rebecca L. Kendall, Oviedo, FL (US); Piyush Sane, Orlando, FL (US)

(72) Inventors: Brian D. Nereim, Winter Springs, FL (US); Rebecca L. Kendall, Oviedo, FL (US); Piyush Sane, Orlando, FL (US)

(73) Assignee: Siemens Aktiengesellschaft, München (DE)

( * ) Notice: Subject to any disclaimer, the term of this patent is extended or adjusted under 35 U.S.C. 154(b) by 521 days.

(21) Appl. No.: 13/665,952

(22) Filed: Nov. 1, 2012

(65) Prior Publication Data

US 2014/0119899 A1 May 1, 2014

(51) Int. Cl.
*F01D 11/00* (2006.01)
*F01D 5/06* (2006.01)

(52) U.S. Cl.
CPC *F01D 5/06* (2013.01); *F01D 5/066* (2013.01); *F01D 11/005* (2013.01); *F05D 2240/55* (2013.01)

(58) Field of Classification Search
None
See application file for complete search history.

(56) References Cited

U.S. PATENT DOCUMENTS

| | | | | |
|---|---|---|---|---|
| 5,320,488 | A | 6/1994 | Meade et al. | |
| 5,865,600 | A | 2/1999 | Mori et al. | |
| 5,882,012 | A * | 3/1999 | Niwa et al. | 277/407 |
| 5,967,746 | A | 10/1999 | Hagi et al. | |
| 6,089,827 | A | 7/2000 | Ichiryu et al. | |
| 6,315,301 | B1 | 11/2001 | Umemura et al. | |
| 7,470,113 | B2 | 12/2008 | Tran et al. | |
| 7,549,845 | B2 | 6/2009 | Uwami et al. | |
| 7,581,931 | B2 | 9/2009 | Shaefer et al. | |
| 2009/0191050 | A1 | 7/2009 | Nereim et al. | |
| 2010/0074731 | A1 | 3/2010 | Wiebe et al. | |
| 2012/0308368 | A1 * | 12/2012 | Helvaci | 415/175 |
| 2013/0104565 | A1 * | 5/2013 | Casavant et al. | 60/805 |

FOREIGN PATENT DOCUMENTS

| | | | |
|---|---|---|---|
| EP | 0979961 | A1 | 2/2000 |
| KR | 20110035507 | A | 4/2011 |

* cited by examiner

*Primary Examiner* — Christopher Verdier
*Assistant Examiner* — Justin Seabe

(57) ABSTRACT

A sealing band for use in a turbomachine having a plurality of stages, each stage comprising a rotatable disk and blades carried thereby. At least one pair of adjacent rotatable disks define an annular gap therebetween and have respective opposing sealing band receiving slots aligned with the annular gap. The sealing band includes a plurality of seal strips located in series adjacent to one another, and adjacent seal strips include opposing end faces located in facing relationship adjacent to one another. An underlap portion is affixed adjacent to an end of at least one seal strip and extends past the end face of an adjacent seal strip, along a radially facing side of the adjacent seal strip.

13 Claims, 3 Drawing Sheets

BELLY BAND SEAL WITH UNDERLAPPING ENDS

FIELD OF THE INVENTION

This invention relates in general to seals for multistage turbomachines and, more particularly, to an optimized baffle seal provided between adjoining disks in a multistage turbomachine.

BACKGROUND OF THE INVENTION

In various multistage turbomachines used for energy conversion, such as turbines, a fluid is used to produce rotational motion. In a gas turbine, for example, a gas is compressed through successive stages in a compressor and mixed with fuel in a combustor. The combination of gas and fuel is then ignited for generating combustion gases that are directed to turbine stages to produce the rotational motion. The turbine stages and compressor stages typically have stationary or non-rotary components, e.g., vane structures, that cooperate with rotatable components, e.g., rotor blades, for compressing and expanding the operational gases.

The rotor blades are typically mounted to disks that are supported for rotation on a rotor shaft. Annular arms extend from opposed portions of adjoining disks to define paired annular arms. A cooling air cavity is formed on an inner side of the paired annular arms between the disks of mutually adjacent stages, and a labyrinth seal may be provided on the inner circumferential surface of the stationary vane structures for cooperating with the annular arms to effect a gas seal between a path for the hot combustion gases and the cooling air cavity. The paired annular arms extending from opposed portions of adjoining disks define opposing end faces located in spaced relation to each other. Typically the opposing end faces may be provided with a slot for receiving a sealing band, known as a "baffle seal" or "belly band seal", which bridges the gap between the end faces to prevent cooling air flowing through the cooling air cavity from leaking into the path for the hot combustion gases. The sealing band may be formed of plural segments, in the circumferential direction, that are typically interconnected at a sealing joint such as at a shiplap joint between the ends to prevent passage of gases past the joint.

SUMMARY OF THE INVENTION

In accordance with one aspect of the invention, a sealing band is provided for use in a turbomachine having a plurality of stages, each stage comprising a rotatable disk and blades carried thereby. At least one pair of adjacent rotatable disks define an annular gap therebetween and have respective opposing sealing band receiving slots aligned with the annular gap. The sealing band comprises a plurality of seal strips located in series adjacent to one another, and adjacent seal strips include opposing end faces located in facing relationship adjacent to one another. An underlap portion is affixed adjacent to an end of at least one seal strip and extends past the end face of an adjacent seal strip, along a radially facing side of the adjacent seal strip.

The underlap portion may have a width, extending across the gap, that is less than a width of the at least one seal strip.

The at least one seal strip may have a width greater than the annular gap, and the underlap portion may have a width no greater than the annular gap.

The underlap portion may have a width less than the annular gap.

The underlap portion may be attached in abutting relation to the end face of the at least one seal strip.

The underlap portion may extend radially away from a radially facing side of the at least one seal strip.

The radially facing side of both the at least one seal strip and the adjacent seal strip may face radially inwardly of the at least one pair of adjacent rotatable disks.

The underlap portion may extend radially beyond the sealing band receiving slots.

The adjacent disks may include opposing disk end faces defining the annular gap therebetween, and the underlap portion may include opposing sides extending adjacent and parallel to the opposing disk end faces.

In accordance with another aspect of the invention, a sealing band is provided in a turbomachine having a plurality of stages, each stage comprising a rotatable disk and blades carried thereby. At least one pair of adjacent rotatable disks define an annular gap therebetween and have respective opposing sealing band receiving slots aligned with the annular gap. The sealing band comprises a plurality of seal strips located in series adjacent to one another. Adjacent seal strips including opposing end faces located in facing relationship adjacent to one another, each seal strip including opposing radially outwardly and inwardly facing seal strip faces. An underlap portion is affixed adjacent to an end face of at least one seal strip and extends circumferentially past the end face of an adjacent seal strip, along the inwardly facing seal strip face of the adjacent seal strip. The underlap portion comprises opposing radially outwardly and inwardly facing underlap faces, wherein the outwardly facing underlap face is coplanar with the inwardly facing seal strip face.

The sealing band receiving slots may be formed in disk arms associated with each of the adjacent disks, the annular gap being defined between spaced disk arm faces formed on the disk arms, and the underlap portion having opposing sides, each underlap portion side may be located adjacent to a respective disk arm face.

The outwardly facing underlap face may form a planar surface between the underlap portion sides.

A distance between the underlap portion sides may be no greater than a distance between the disk arm faces.

The underlap portion may comprise a separate element attached to the end of the at least one seal strip.

A section of the underlap portion adjacent to the at least one seal strip has a width substantially equal to a width of the seal strip.

The underlap portion includes an underlap element having a width that is less than a width of the annular gap and defining the outwardly facing underlap face.

The underlap portion may extend radially inwardly beyond the sealing band receiving slots, and may define a seal spanning between the pair of adjacent disks and closing a gap between the end face of the at least one seal strip and the end face of the adjacent seal strip.

BRIEF DESCRIPTION OF THE DRAWINGS

While the specification concludes with claims particularly pointing out and distinctly claiming the present invention, it is believed that the present invention will be better understood from the following description in conjunction with the accompanying Drawing Figures, in which like reference numerals identify like elements, and wherein:

DETAILED DESCRIPTION OF THE INVENTION

In the following detailed description of the preferred embodiment, reference is made to the accompanying drawings that form a part hereof, and in which is shown by way of illustration, and not by way of limitation, a specific preferred embodiment in which the invention may be practiced. It is to be understood that other embodiments may be utilized and that changes may be made without departing from the spirit and scope of the present invention.

Figure 1:
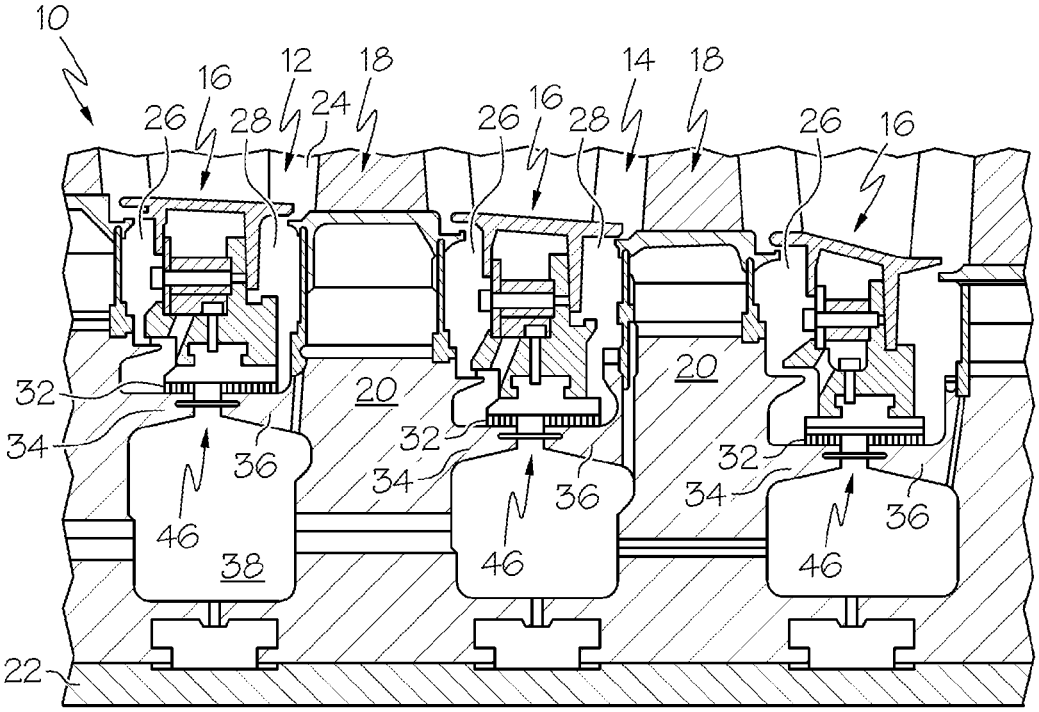
FIG. 1 is a diagrammatic section view of a portion of a gas turbine engine including a seal strip assembly in accordance with the present invention.

Referring to FIG. 1, a portion of a turbine engine 10 is illustrated diagrammatically including adjoining stages 12, 14, each stage 12, 14 comprising an array of stationary vane assemblies 16 and an array of rotating blades 18, where the vane assemblies 16 and blades 18 are positioned circumferentially within the engine 10 with alternating arrays of vane assemblies 16 and blades 18 located in the axial direction of the turbine engine 10. The blades 18 are supported on rotor disks 20 secured to adjacent disks with spindle bolts 22. The vane assemblies 16 and blades 18 extend into an annular gas passage 24, and hot gases directed through the gas passage 24 flow past the vane assemblies 16 and blades 18 to remaining rotating elements.

Disk cavities 26, 28 are located radially inwardly from the gas passage 24. Purge air is preferably provided from cooling gas passing through internal passages in the vane assemblies 16 to the disk cavities 26, 28 to cool the blades 18 and to provide a pressure to balance against the pressure of the hot gases in the gas passage 24. In addition, interstage seals comprising labyrinth seals 32 are supported at the radially inner side of the vane assemblies 16 and are engaged with surfaces defined on paired annular disk arms 34, 36 extending axially from opposed portions of adjoining disks 20. An annular cooling air cavity 38 is formed between the opposed portions of adjoining disks 20 on a radially inner side of the paired annular disk arms 34, 36. The annular cooling air cavity 38 receives cooling air passing through disk passages to cool the disks 20.

Figure 2:
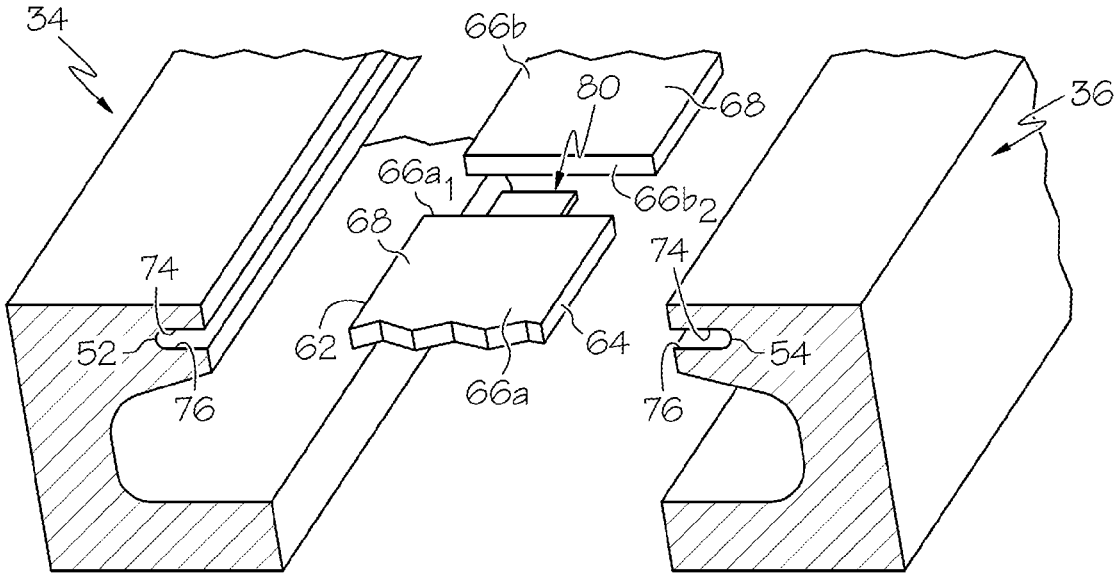
FIG. 2 is an exploded perspective view illustrating aspects of the present invention.

Referring further to FIG. 2, the disk arms of two adjoining disks 20 are illustrated for the purpose of describing the seal strip assembly 46 of the present invention, it being understood that the disks 20 and associated disk arms 34, 36 define an annular structure extending the full circumference about the rotor centerline. The disk arms 34, 36 define respective opposed disk end faces 48, 50 located in closely spaced relation to each other. A circumferentially extending sealing band receiving slot 52, 54 is formed in the respective disk end faces 48, 50, wherein the slots 52, 54 are radially aligned with an annular gap 56 (FIGS. 3 and 4) defined between the disk end faces 48, 50.

Figure 3:
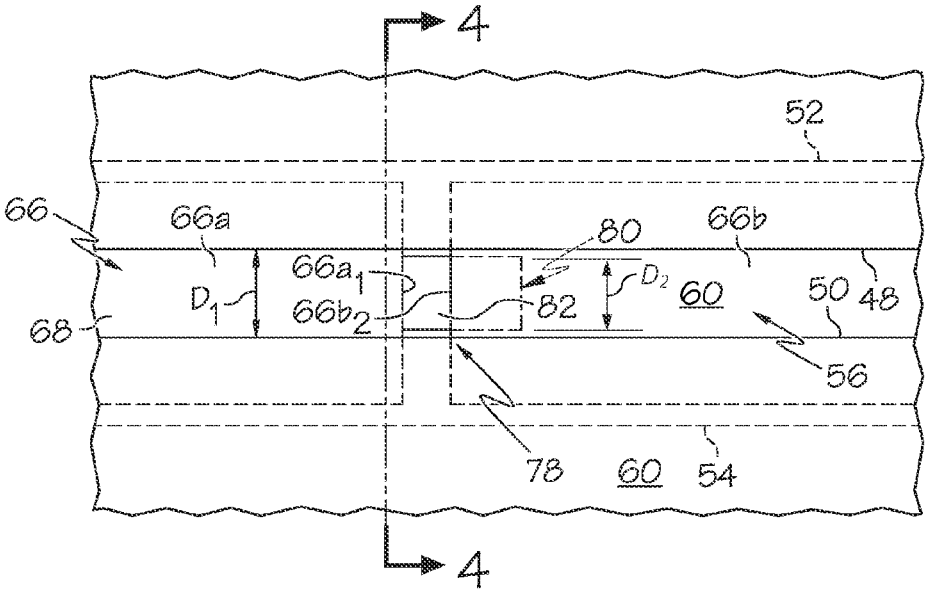
FIG. 3 is a plan view of a pair of seal strips assembled extending between adjacent disk arms with an underlap portion forming a seal between end faces of the seal strips.
Figure 4:
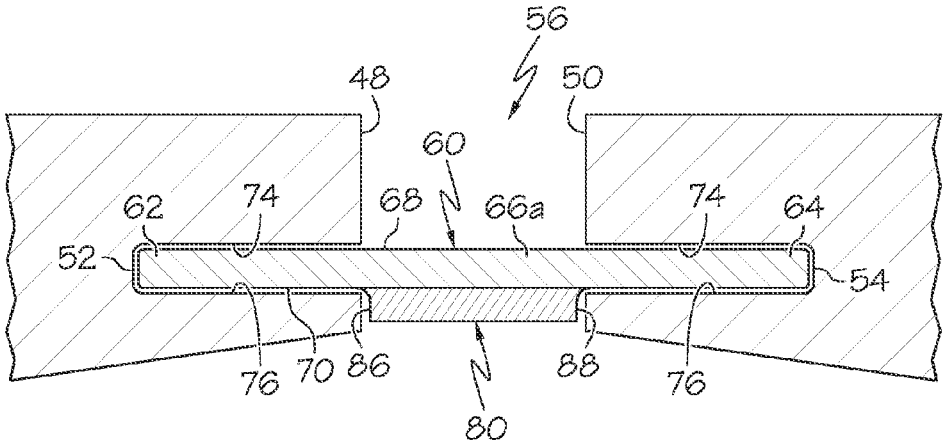
FIG. 4 is a cross-sectional view taken along line 4-4 in FIG. 3.

As seen in FIG. 4, the seal strip assembly 46 includes a sealing band 60 forming a circumferentially extending belly band seal. The sealing band 60 includes opposing sealing band edges 62, 64 which are positioned within the respective slots 52, 54 defined in the opposed end faces 48, 50. The sealing band 60 spans the annular gap 56 between the end faces 48, 50 and defines a seal for preventing or substantially limiting flow of gases between the cooling air cavity 38 and the disk cavities 26, 28. Further, the sealing band 60 is comprised of a plurality of segments, typically four segments, referred to herein as seal strips 66 (FIG. 3).

As seen in FIGS. 2 and 3, a first seal strip 66*a* and a second seal strip 66*b* are located adjacent to each other at respective seal strip end faces $\mathbf{66}a_1$ and $\mathbf{66}b_2$. It may be understood that each seal strip 66 is formed as an elongated member extending circumferentially within the engine 10 and includes a first end face, e.g. first end $\mathbf{66}a_1$ of seal strip 66*a*, and a second end face, e.g., second end face $\mathbf{66}b_2$ of seal strip 66*b*. Referring to FIG. 4, the seal strips 66 also each include a radially outwardly facing seal strip face 68 (hereinafter "outer seal strip face 68") and an opposing radially inwardly facing seal strip face 70 (hereinafter "inner seal strip face 70"). When positioned within the sealing band receiving slots 52, 54, the outer seal strip face 68 is positioned adjacent a radially inwardly facing surface 74 in each of the slots 52, 54, and the inner seal strip face 70 is positioned adjacent a radially outwardly facing surface 76 in each of the slots 52, 54. The thickness of the seal strips 66 is selected such that the dimensional clearance between the seal strip faces 68, 70 and the slot surfaces 74, 76 is minimized to limit leakage past the sealing band 60.

As noted above, a sealing joint, such as a shiplap joint, has typically been provided at the junction between segments of a sealing band. In accordance with an aspect of the invention, it has been observed that the reduced material thickness provided at shiplap joints, i.e., where the ends of the segments are reduced to about half thickness of the sealing band, is a potentially structurally weak location on the sealing band. The thinner material of the sealing band segments at the shiplap location may be subject to fracturing, which may form a breach in the seal with a resulting leakage of cooling air through the belly band.

Figure 5A:
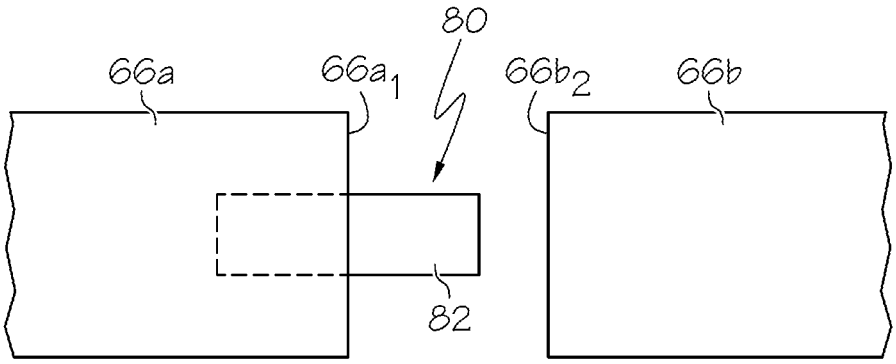
FIG. 5A is a plan view illustrating an underlap portion on a seal strip prior to movement into underlapping relation to an adjacent seal strip.

Further in accordance with an aspect of the invention, an underlap seal 78 is provided to optimize sealing and facilitate durability at the junction between seal strips 66. As may be best seen in FIGS. 2, 3 and 5A, the underlap seal 78 is formed by an underlap portion 80 comprising an elongated member that is affixed to the first seal strip 66*a* at or adjacent to the first seal strip end face $\mathbf{66}a_1$. It should be understood that the underlap portion 80 may be formed as a separate element that is attached to first seal strip 66*a* by welding or other attachment technique, or the underlap portion 80 may be formed integrally at the first end face $\mathbf{66}a_1$ during a manufacturing process forming the first seal strip 66*a*. Hence, the term "affixed" as used herein may reference either attachment of the underlap portion 80 provided as a separate element, or integral formation of the underlap portion 80 with the seal strip 66*a*, such as may be provided during a manufacturing process forming the first end face $\mathbf{66}a_1$.

Figure 5B:
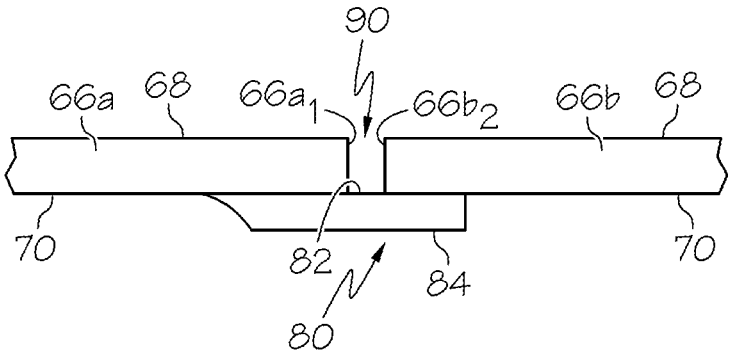
FIG. 5B is a side view illustrating the underlapping portion in an assembled position, forming a seal between adjacent seal strips.

The underlap portion 80 described herein has a generally rectangular cross-section, as may be seen in FIG. 4, however other shapes that provide equivalent functional advantages as described herein are equally encompassed by the present description. As seen in FIG. 5B, the underlap portion 80 includes a radially outwardly facing underlap face 82 (hereinafter "outer underlap face 82") formed as a planar surface, and an opposing radially inwardly facing underlap face 84 (hereinafter "inner underlap face 84"), which may also be a planar surface. The outer and inner underlap faces 82, 84 are connected by opposing underlap portion sides 86, 88. The underlap portion sides 86, 88 extend adjacent and parallel to the respective disk end faces 48, 50. Hence, when the seal strip 66*a* is positioned within the slots 52, 54, the underlapping portion 80 extends radially inwardly from the inner seal strip face 70, i.e., radially inwardly from the slots 52, 54, into the annular gap 56. It may be noted that the underlap portion 80 may be formed with a radial thickness, i.e., the dimension between the outer and inner underlap faces 82, 84, that is substantially equal to a radial thickness of the seal strips 66, as measured between the outer and inner seal strip faces 68, 70.

In the illustrated embodiment, the outer underlap face 82 is shown as being coplanar with or generally coplanar, i.e., generally lying in a common plane, with the inner seal strip face 70. For example, the underlap portion 80 may be welded in position on the seal strip 66*a* with a portion of the outer underlap face 82 in contact with the inner seal strip face 70, and with the remainder of the outer underlap face 82 extending outwardly from the first end face 66$a_1$ of the seal strip 66*a*.

As may be seen in FIG. 4, the width of the underlap portion 80 is less than the width of the seal strips 66. Referring further to FIG. 3, the underlap portion 80 is dimensioned such that an axial width of the underlap portion 80, as measured by the distance $D_2$ between the underlap portion sides 86, 88 is no greater that the axial width of the annular gap 56 as measured by the distance $D_1$ between the disk end faces 48, 50. Preferably, the axial width $D_2$ of the underlap portion 80 is slightly less than the axial width $D_1$ of the annular gap 56 to accommodate variations in the axial width D1 of the annular gap 56, such as may be caused by relative axial movement of the adjoining disks 20.

In a particular, non-limiting example of the seal strip assembly 46, a nominal distance $D_1$ between the disk end faces 48, 50 may be about 12.7 mm, and a nominal width of the underlap portion 80 may be about 11 mm, such that a nominal gap of about 0.85 mm may be formed between the disk end faces 48, 50 and each of the respective sides 86, 88 of the underlap portion 80. It may be understood that the exemplary dimensions described above may be measured when the components are cold, and that a dimension of the gap between the underlap portion 80 and the disk end faces 48, 50 may decrease when the components are at a higher or "hot" temperature, such as during operation of the engine 10.

As seen in FIGS. 3 and 5B, in an assembled state of the sealing band 60, the underlap portion 80 extends underneath, i.e., underlaps, the second seal strip 66*b*. In particular, the underlap portion 80 extends past the second seal strip end face 66$b_2$ and under the second seal strip 66*b* to position the outer underlap face 82 in engagement with the inner seal strip face 70 of the second seal strip 66*b*. That is, in a final position of the seal strips 66, a substantial portion of the length of the underlap portion 80 extending beyond the first seal strip end face 66$a_1$ is located under the second seal strip 66*b*, and a relatively smaller section of the underlap portion 80 spans a gap 90 that may be formed between the opposing seal strip end faces 66$a_1$ and 66$b_2$.

It should be noted that the relative position between adjacent ones of the seal strips 66 may be maintained by anti-rotation structure associated with each of the seal strips 66. For example, an anti-rotation structure such as is disclosed in U.S. Pat. No. 7,581,931 may be provided, which patent is incorporated herein by reference. The anti-rotation device provided to each seal strip 66 substantially limits circumferential movement of the seal strips 66 relative to the adjacent disks 20 and relative to each other.

As described above, the underlap portion 80 extends substantially the entire axial width $D_1$ of the annular gap 56, and substantially prevents or limits passage of cooling air to the seal strips 66*a* and 66*b* at the location of the underlap portion 80. In particular, the underlap portion sides 86, 88 extend radially inwardly from the inner seal strip face 70, i.e., radially inwardly from the radially outwardly facing surface 76 of the slots 52, 54, to form a seal with the adjacent disk end faces 34, 36 to prevent or limit passage of air around the underlap portion 80 at the circumferential location of the gap 90 between the seal strip end faces 66$a_1$, 66$b_2$.

As noted above, although the underlap portion 80 is illustrated as a separate element attached to the seal strip 66*a*, the underlap portion 80 may be formed as an integral feature on the seal strip 66*a*, such as during manufacture of the seal strip 66*a*. For example, the underlap portion 80 may be formed through use of a combination of forging and machining operations in which the end of the first seal strip 66*a* is shaped to configure the underlap portion 80 as an integral part of the seal strip 66*a*.

Figure 6:
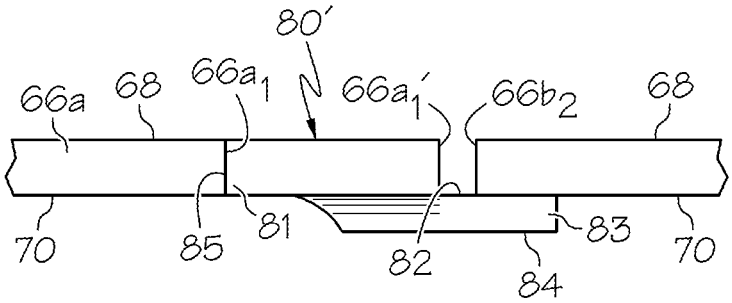
FIG. 6 is a view similar to FIG. 5B illustrating an alternative structure providing an attachment of an underlap portion to a seal strip.

Alternatively, as is illustrated in FIG. 6, an underlap portion 80' may be provided that forms an end of the first seal strip 66*a*. In particular, the underlap portion 80' may comprises a seal strip end 81 having a width that is generally the same as an end face 66$a_1$ of the first seal strip 66*a*, and further includes an end face 66$a_1$' having the same width as the seal strip end 81. The underlap portion 80' includes an integrally formed underlap element 83 having a width that is generally the same as the axial width $D_2$ described above for the underlap portion 80.

The underlap portion 80' may be affixed to the end face 66$a_1$ of the first seal strip 66*a* at a butt weld connection 85, such that the underlap portion 80' forms an extension of the seal strip 66*a* wherein the end face 66$a_1$' is located in opposing relation to the end face 66$b_2$ of the second seal strip 66*b*. The underlap element 83 defines a seal extending in underlapping relation to the second seal strip 66*b* in the same manner as described above for the underlap portion 80.

It should be understood that, although various structures are described for providing an underlap portion, such as are described for the underlap portions 80, 80', within the spirit and scope of the present invention, any manner of attachment or formation techniques may be implemented to provide an underlap portion 80, as described herein, for sealing between adjacent seal strips 66.

Further, although the underlap portion 80 is described with particular reference to the end of the first seal strip 66*a*, it may be understood that in a practical embodiment of the invention, an underlap portion 80 may be provided to an end of each of the segments or seal strips 66 forming the sealing band for underlapping with an adjacent seal strip end.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A sealing band for use in a turbomachine having a plurality of stages, each stage comprising a rotatable disk and blades carried thereby, at least one pair of adjacent rotatable disks defining an annular gap therebetween and having respective opposing sealing band receiving slots aligned with the annular gap, the sealing band comprising:

a plurality of adjacent seal strips located in series adjacent to one another, and the adjacent seal strips including opposing end faces located in facing relationship adjacent to one another wherein said seal strips have a width greater than said annular gap;

an underlap portion is affixed adjacent to an end of at least one of said seal strips and extends past the end face of an adjacent one of said seal strips, along a radially facing side of said adjacent one of said seal strips; and wherein said underlap portion has a width, extending across said gap, that is less than a width of said at least one seal strip and said underlap portion has a width no greater than said annular gap.

2. The sealing band of claim 1, wherein said underlap portion has a width less than said annular gap.

3. The sealing band of claim 1, wherein said underlap portion is attached in abutting relation to the end face of said at least one seal strip.

4. The sealing band of claim 3, wherein said underlap portion extends radially away from a radially facing side of said at least one seal strip.

5. The sealing band of claim 3, wherein said radially facing side of both said at least one seal strip and said adjacent seal strip faces radially inwardly of said at least one pair of adjacent rotatable disks.

6. The sealing band of claim 1, wherein said underlap portion extends radially beyond said sealing band receiving slots.

7. The sealing band of claim 6, wherein said adjacent disks include opposing end faces defining said annular gap therebetween, and said underlap portion includes opposing sides extending adjacent and parallel to said opposing side faces.

8. A sealing band in a turbomachine having a plurality of stages, each stage comprising a rotatable disk and blades carried thereby, at least one pair of adjacent rotatable disks defining an annular gap therebetween and having respective opposing sealing band receiving slots aligned with the annular gap, the sealing band comprising:

a plurality of adjacent seal strips located in series adjacent to one another, and the adjacent seal strips including opposing end faces located in facing relationship adjacent to one another, each said seal strip including opposing radially outwardly and inwardly facing seal strip faces;

an underlap portion is affixed adjacent to an end face of at least one of said seal strips and extends circumferentially past the end face of an adjacent one of said seal strips, along the inwardly facing seal strip face of said adjacent one of said seal strips; and said underlap portion comprises opposing radially outwardly and inwardly facing underlap faces, wherein said outwardly facing underlap face is coplanar with said inwardly facing seal strip face;

wherein said sealing band receiving slots are formed in disk arms and associated with each of said adjacent disks, said annular gap being defined between spaced disk arm faces formed on said disk arms, and said underlap portion having opposing sides, each underlap portion side located adjacent to a respective disk arm face;

wherein said opposing sides of the underlap portion define a width, extending across said gap, that is less than a width of said at least one seal strip, and said width defined by said opposing sides of said underlap portion is no greater than said annular gap.

9. The sealing band of claim 8, wherein said outwardly facing underlap face forms a planar surface between said underlap portion sides.

10. The sealing band of claim 8, wherein said underlap portion comprises a separate element attached to said end of said at least one seal strip.

11. The sealing band of claim 10, wherein a section of said underlap portion adjacent to said at least one seal strip has a width substantially equal to a width of said seal strip.

12. The sealing band of claim 11, wherein said underlap portion includes an underlap element defining said outwardly facing underlap face.

13. The sealing band of claim 8, wherein said underlap portion extends radially inwardly beyond said sealing band receiving slots, and defines a seal spanning between said pair of adjacent disks and closing a gap between said end face of said at least one seal strip and said end face of said adjacent seal strip.

* * * * *